US005311487A

United States Patent [19]

Mininni et al.

[11] Patent Number: 5,311,487

[45] Date of Patent: May 10, 1994

[54] ELECTROMECHANICAL WRISTWATCH WITH READING BY TOUCH

[76] Inventors: Gianni Mininni, 4, Via P. Paoli, Milan, Italy, 20143; Eugenio Michelotti, 49, Corso Garibaldi, Milan, Italy, 20121

[21] Appl. No.: 910,697

[22] Filed: Jul. 8, 1992

[30] Foreign Application Priority Data

Jul. 9, 1991 [IT] Italy ..... MI91A001894

[51] Int. Cl.[5] ..... G04B 25/02; G04G 9/08

[52] U.S. Cl. ..... 368/230

[58] Field of Search ..... 368/222-239

[56] References Cited

U.S. PATENT DOCUMENTS

| | | | |
|---|---|---|---|
| 2,208,366 | 7/1940 | Hamilton . | |
| 3,648,647 | 3/1972 | Joy | 116/205 |
| 3,974,444 | 8/1976 | Whitaker . | |

FOREIGN PATENT DOCUMENTS

| | | | |
|---|---|---|---|
| 0428981 | 5/1991 | European Pat. Off. . | |
| 3106656 | 9/1982 | Fed. Rep. of Germany . | |
| 2117886 | 7/1972 | France . | |
| 111492 | 7/1982 | Japan . | |
| 158581 | 9/1982 | Japan | 368/230 |
| 618827 | 8/1980 | Switzerland . | |
| 1285426 | 1/1987 | U.S.S.R. . | |
| 604621 | 7/1948 | United Kingdom . | |

*Primary Examiner*—Bernard Roskoski
*Attorney, Agent, or Firm*—Darby & Darby

[57] ABSTRACT

An electromechanical wristwatch is described with the particular characteristic of being readable both by sight or by touch in that the hours and minutes are indicated in two square areas. In each of these areas are four cursors which, by means of electrical impulses, which come out of or go back into the case. Said reading by touch can thus be interpreted by means of a series of combinations of the said cursors, which permit the time to be determined with an interval of five minutes.

15 Claims, 3 Drawing Sheets

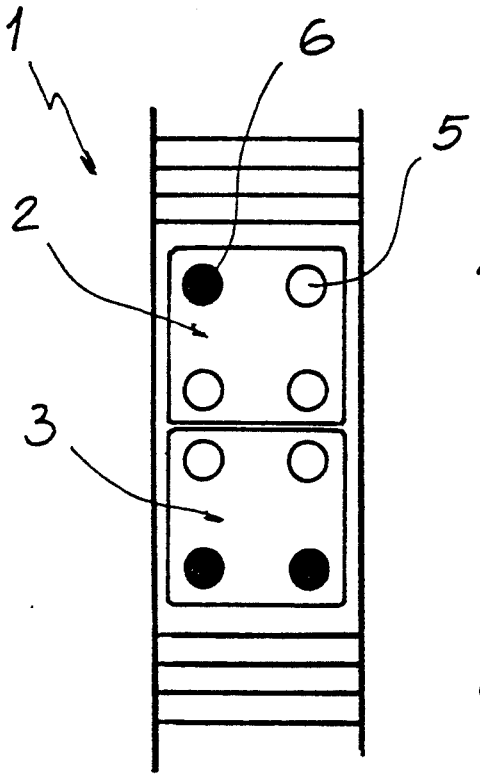
Fig. 4
Fig. 5
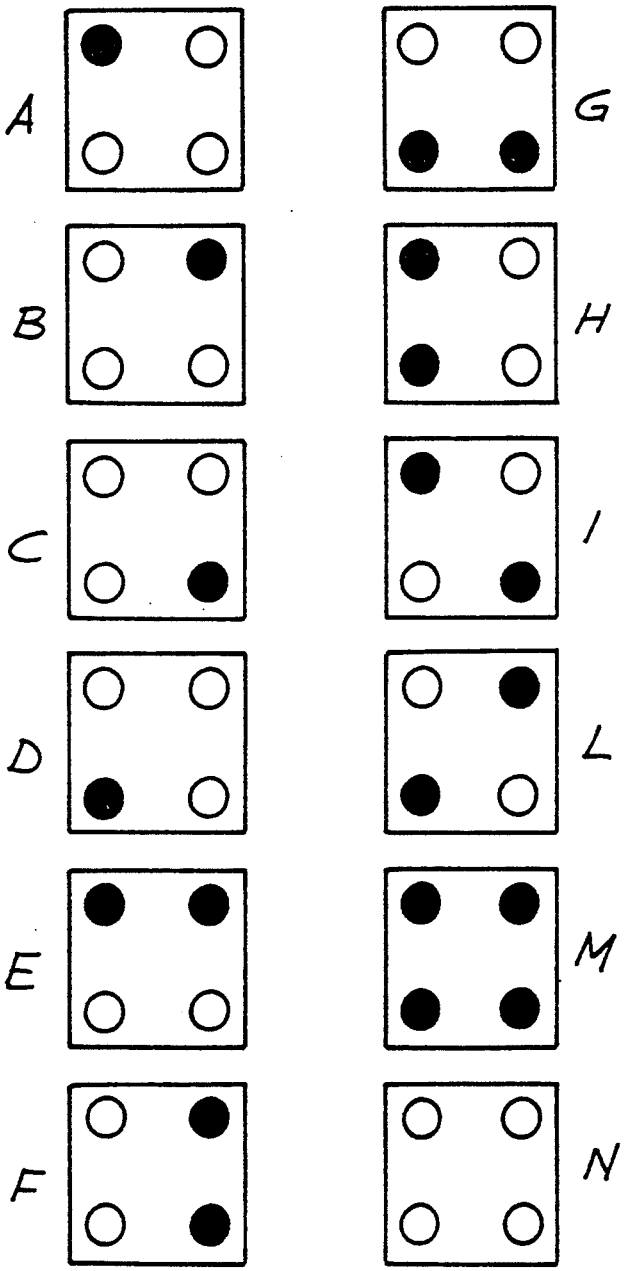

ELECTROMECHANICAL WRISTWATCH WITH READING BY TOUCH

The invention refers to a wristwatch with two square areas each area having four cursors which come out of and go back into the case by means of suitable electric impulses, forming different and codified combinations which can be interpreted either by sight or by touch.

The object of the latter use is to allow the time to be told in any situation in which it is not possible to look away from what one is doing or also in other special cases.

It is known that in the sector of watchmaking other methods of reading have been devised for persons who are not able to carry out direct reading of a watch face, or for special uses such as in the armed forces for night duty, or for the blind.

One of these is that carried out by means of modulated sounds emitted by a microprocessor, another is by means of acoustic signals reproducing a synthesised voice electronically and another again by reading by touch by putting the hands of the watch itself in relief on a particularly sophisticated face.

These and other methods have certainly made telling the time easier but they have also been shown to be techniques subject to frequent variation as they are governed by micro-components which are not easily available on the market and are still not reliable in the long term.

The present invention however concerns a simple solution which is at the same time reliable in that it utilises a microprocessor which, by means of electrical impulses, attracts or releases the cylinders in the two distinct areas of the watch forming the combinations of reading by touch both of the hours and the minutes with an interval of five minutes.

Those and other particular characteristics of the invention will be shown better in the following detailed description, given purely as an example without limiting the scope of the invention and with reference to the appended sheets of illustrative drawings, in which:

FIG. 4 shows a schematic view of the watch indicating the time 35 minutes past 1 as a practical example of telling the time; and FIG. 5 shows an illustrative scheme emphasising the various combinations which are intelligible by touch.

Figure 1:
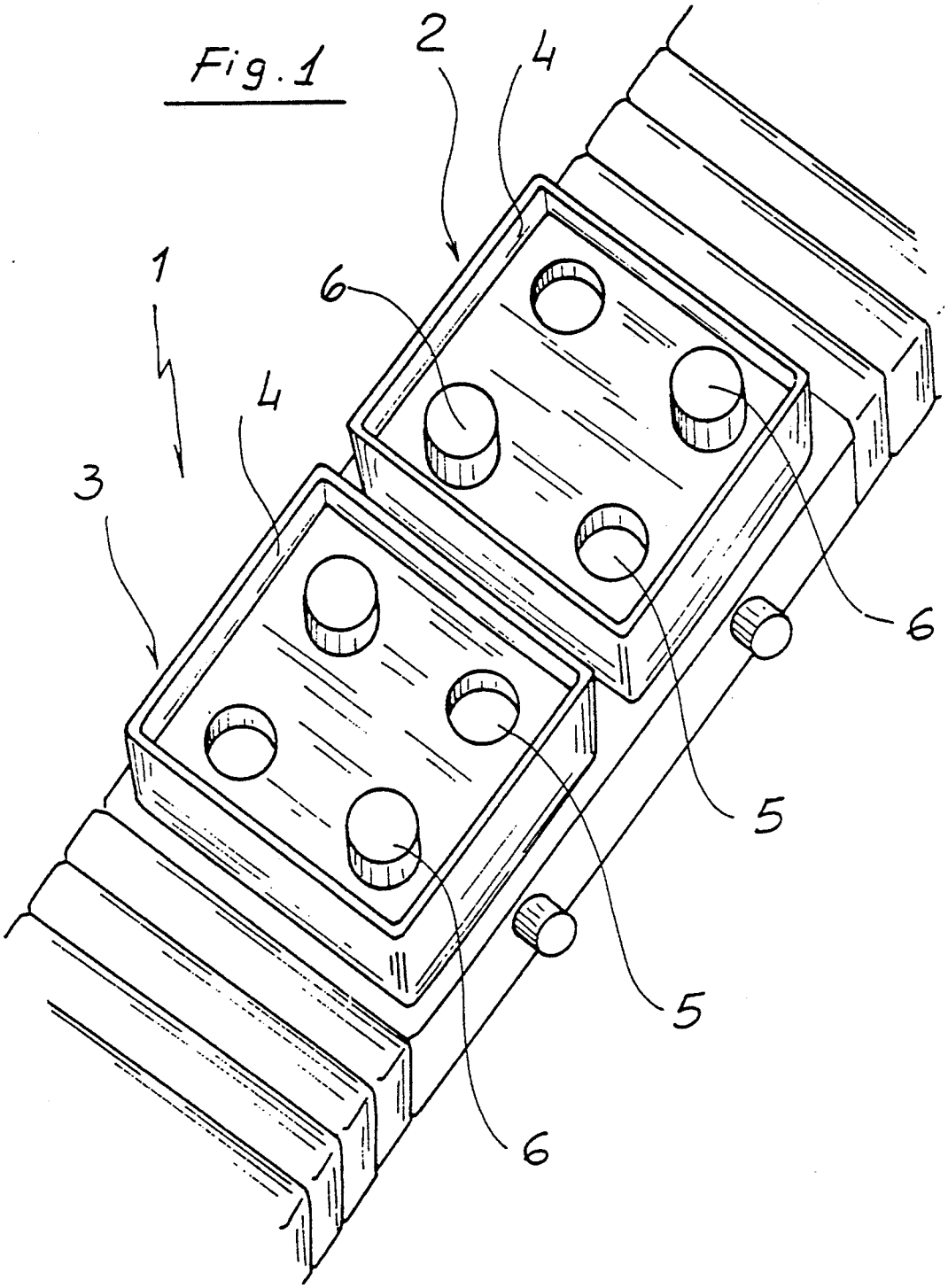
FIG. 1 shows a perspective view of the watch, showing the two square areas for the reading of the hours and minutes, enclosed within a surrounding protective frame.

With reference to FIG. 1 of the appended drawings, the watch 1 in question comprises two square areas 2 and 3 enclosed in a protective surrounding frame 4, in which there are four holes 5 for each of said square areas. In said holes respective cursors or cylinders 6 are positioned which come out and go back in for the codification by touch and by sight of the hours and minutes.

The hours are marked in different combinations in the upper square 2 and the minutes, with an interval of 5 minutes, in the lower square 3.

Figure 2:
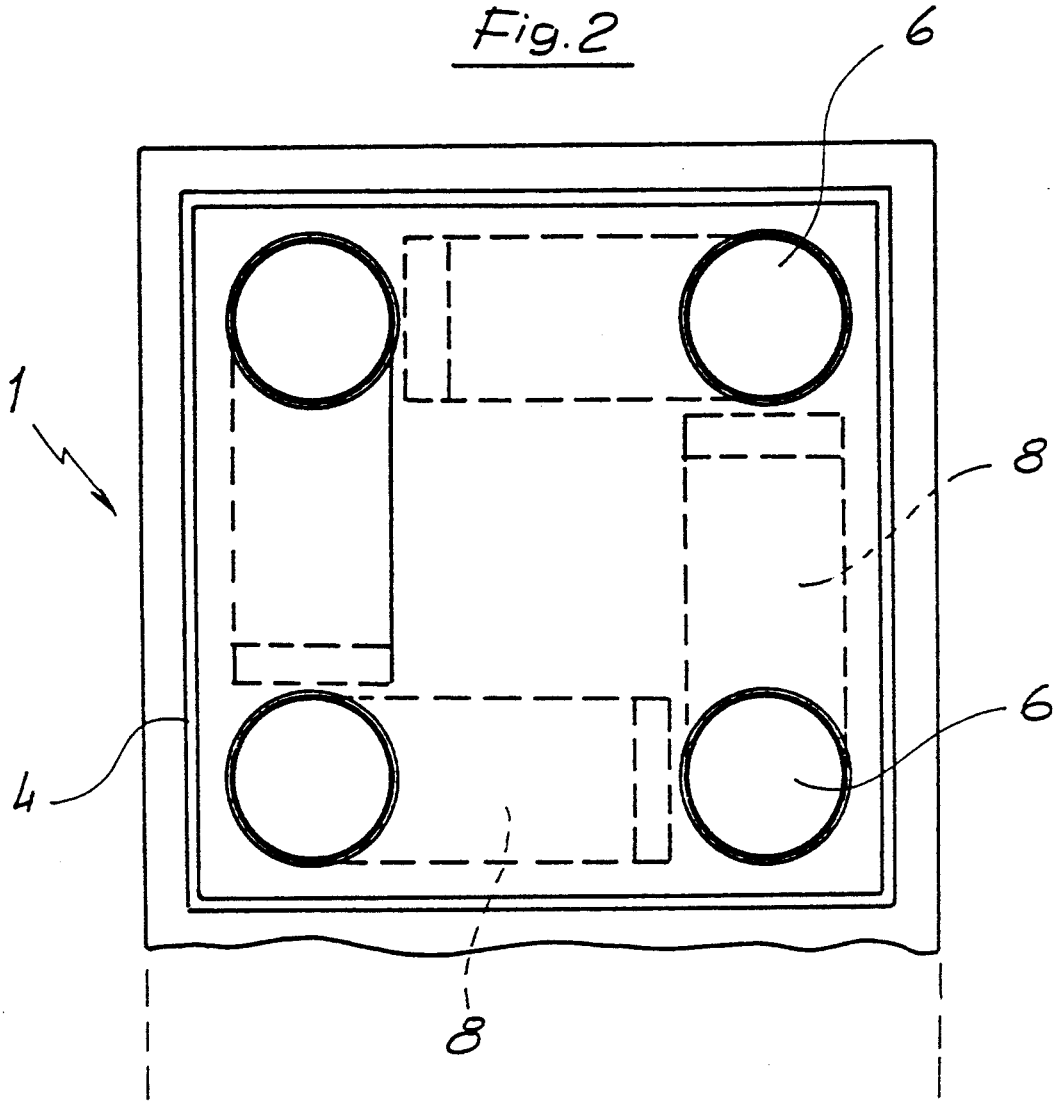
FIG. 2 shows a schematic plane view of one of the two square areas showing the controlling plates enclosed within the watch case.
Figure 3:
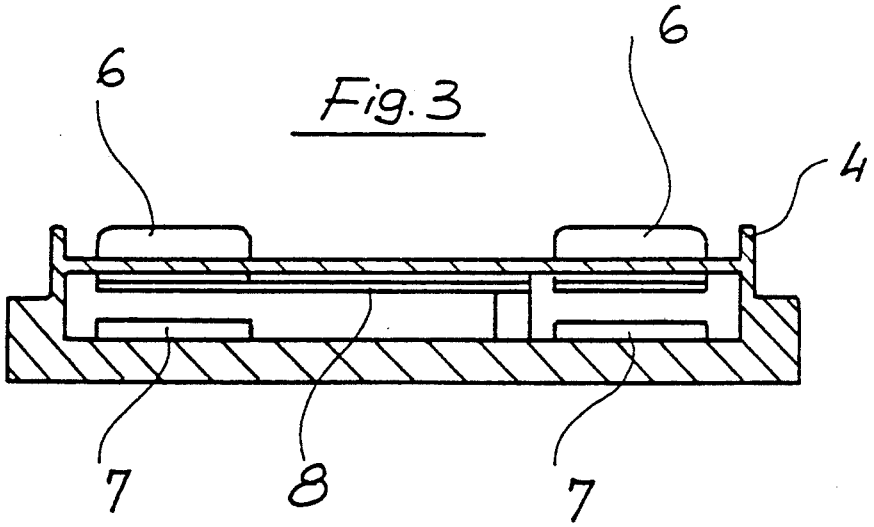
FIG. 3 shows a schematic section of the watch, showing the internal plates and relative electromagnets, suitable for attracting and releasing the cursors, according to a codified sequence.

With reference to FIGS. 2 and 3, the working of cylinders 6 is obtained by means of small electromagnets 7 which attract the internal blades 8.

Said electromagnets 7 are activated by means of codified impulses by a microprocessor taking into consideration that the blades and therefore the cylinders are raised when in the resting state.

With reference to FIG. 5, to clarify still better the codification of the reading, the 12 codes relating to the hours marked in the upper square 2 are as follows: position A, one o'clock; pos. B, two o'clock; pos. C, three o'clock; pos. D, four o'clock; pos. E, five o'clock; pos. F, six o'clock; pos. G, seven o'clock; pos. H, eight o'clock; pos. I, nine o'clock; pos. L, ten o'clock; pos. M, eleven o'clock; pos. N, twelve o'clock.

In the various codes one must note that the same are obtained by activating cyclically one, two, three or four cylinders, and finally the absence of the same, this last position marking 12 o'clock.

Exactly the same codes, in the lower square area 3, indicate the fractions of the hour with an interval of 5 minutes with the said sequential progression as described above for the hours. Therefore, with reference again to the list in FIG. 5, in the lower square area 3 the position A indicates 5 minutes; position B 10 minutes; pos. C 15 minutes; pos. D 20 minutes; pos. E 25 minutes; pos. F 30 minutes; pos. G 35 minutes; Pos. H 40 minutes-pos. I 45 minutes; pos. L 50 minutes; pos. M 55 minutes, pos. N 60 minutes or zero.

In practice, with reference to the practical example of reading of FIG. 4, to indicate one o'clock one will have a single cylinder 6 identified either by touch or by sight in the upper square 2, while in the lower one 3 the two cylinders 6 at the bottom indicate 35 minutes.

Naturally the protrusion of the cursors, also allows reading of the hours visually, when it is not necessary not to look away from what one is doing.

From this detailed description one can see that this invention is a correct and practical solution to allow telling the time without requiring the use of sight for anyone who needs to make use of this wristwatch and therefore the use of this watch is extremely useful also for the blind.

Although the preferred form of embodiment illustrated and described is a wristwatch, it is clear that the constructive principles of this watch could also be applied to a different type of watch or clock, for example a pocket watch, desk clock and/or even a wall clock.

One must finally emphasise the fact that this form of embodiment is not limiting of the invention, but on the contrary one must understand that numerous modifications, additions, variations or substitutions of elements can be brought to this invention, without thus altering either its spirit or its object, and also without leaving its scope of protection, as is also defined in the appended claims.

We claim:

1. A touch sensitive time indicator comprising a housing having at least two sections; at least four indicators in each section operable between an extended position in which said indicator extends outwardly of said housing and a retracted position in which said indicator is positioned within the housing; a plurality of openings in said housing in one-in-one correspondence with said indicators to permit each said indicator to move between said extended and retracted positions; biasing means within said housing for biasing each of said indicators to the extended position; and electromagnetic means associated with each of said indicators for moving selected ones of said indicators to the retracted position in timed sequence.

2. A touch sensitive time indicator as in claim 1, in which said indicators are cylindrical, and said plurality of housing openings are circular.

3. A touch sensitive time indicator as in claim 1, in which said two sections comprise juxtaposed quadrilaterals, and each said indicator within said section is positioned adjacent a different corner of said quadrilateral.

4. A touch sensitive time indicator as in claim 3, in which said quadrilaterals comprise a square.

5. A touch sensitive time indicator as in claim 1, in which each of said indicators includes a bottom surface, and said biasing means comprises a leaf spring for each of said indicators, said leaf spring being connected at one end to said bottom surface of the associated indicator, and at the other end to said housing.

6. A touch sensitive time indicator as in claim 5, in which said electromagnetic means comprises a respective electromagnetic positioned below the bottom surface of each of said indicators and spaced therefrom by a distance sufficient to permit the associated indicator to move to the retracted position upon energization of the associated electromagnet.

7. A touch sensitive time indicator as in claim 1, in which one of said sections indicates the hour and the other of said sections indicates the minutes in five minute intervals.

8. A touch sensitive time indicator as in claim 3, in which a first of said sections indicates hours and the second of said sections indicates minutes in five minute intervals, each one of said indicators in said first section individually moving to said extended position under control of said electromagnetic means in timed sequence to indicate the respective hours one o'clock, two o'clock, three o'clock and four o'clock.

9. A touch sensitive time indicator as in claim 16, in which different pairs of adjacent indicators in said first section are moved to the extended position under control of said electromagnetic means to indicate the hours five o'clock, six o'clock, seven o'clock, and eight o'clock.

10. A touch sensitive time indicator as in claim 9, in which said indicators in said first section lying along different diagonals are moved to the extended position under control of said electromagnetic means to indicate the hours nine o'clock and ten o'clock.

11. A touch sensitive time indicator as in claim 10, in which said biasing means moves all of said indicators in said first section to said extended position to indicate eleven o'clock, and said electromagnetic means moves all of said indicators in said first section to the retracted position to indicate twelve o'clock.

12. A touch sensitive time indicator as in claim 11, in which each of said indicators in said second section is individually moved to the extended position under control of said electromagnetic means in timed sequence to indicate respectively 5 minutes, 10 minutes, 15 and 20 minutes.

13. A touch sensitive time indicator as in claim 12, in which different pairs of adjacent indicators in said second section are moved to the extended position under control of said electromagnetic means to indicate respectively 25, 30, 35 and 40 minutes.

14. A touch sensitive time indicator as in claim 13, in which said indicators in said second section lying along different diagonals are moved to the extended position under control of said electromagnetic means to indicate respectively 45 and 50 minutes.

15. A touch sensitive time indicator as in claim 14, in which said biasing means moves all of said indicators in said second section to said extended position to indicate 55 minutes, and said electromagnetic means moves all of said indicators in said second section to the retracted position to indicate 0 minutes.

* * * * *